United States Patent [19]

Froes et al.

[11] Patent Number: 4,828,793

[45] Date of Patent: May 9, 1989

[54] METHOD TO PRODUCE TITANIUM ALLOY ARTICLES WITH HIGH FATIGUE AND FRACTURE RESISTANCE

[75] Inventors: Francis H. Froes, Xenia; Daniel Eylon, Dayton, both of Ohio

[73] Assignee: United States of America as represented by the Secretary of the Air Force, Washington, D.C.

[21] Appl. No.: 198,804

[22] Filed: May 6, 1988

[51] Int. Cl.[4] ..... B22F 7/00

[52] U.S. Cl. ..... 419/6; 419/48; 419/26

[58] Field of Search ..... 419/6, 24, 48

[56] References Cited

U.S. PATENT DOCUMENTS 4,219,357 8/1980 Yolton et al. ..... 419/48
4,505,764 3/1985 Smickley et al. ..... 148/133
4,655,855 4/1987 Levin et al. ..... 148/20.3
4,680,063 7/1987 Vogt et al. ..... 148/11.5

*Primary Examiner*—Stephen J. Lechert, Jr.
*Attorney, Agent, or Firm*—Charles E. Bricker; Donald J. Singer

[57] ABSTRACT

A method for producing an integral titanium alloy article having at least two regions, each region having a distinct microstructure, which comprises the steps of (a) providing a suitable mold for the article;
(b) introducing a first titanium alloy into a first portion of the mold;
(c) introducing a second titanium alloy in powder form into a second portion of the mold; and
(d) hot compacting the first and second alloys in the mold to produce a substantially fully dense article.

The second alloy may be the hydrided version of the first alloy, or may have a different overall composition from the first alloy, or may be hydrided and have a different overall composition from the first alloy.

13 Claims, 2 Drawing Sheets

METHOD TO PRODUCE TITANIUM ALLOY ARTICLES WITH HIGH FATIGUE AND FRACTURE RESISTANCE

RIGHTS OF THE GOVERNMENT

The invention described herein may be manufactured and used by or for the Government of the United States for all governmental purposes without the payment of any royalty.

BACKGROUND OF THE INVENTION

This invention relates to a method for producing an integral titanium alloy article having at least two regions, each region having a distinct microstructure and mechanical properties.

Metal fatigue is one of the major causes for failure of aerospace vehicles and gas turbine engines. The fatigue damage of all technical alloys is divided into two stages: fatigue crack initiation and fatigue crack propagation. In most alloys, the best resistance to fatigue crack initiation is obtained when the material has a very fine microstructure. The best resistance to the propagation stage is associated with a relatively coarse microstructure.

In the alpha+beta titanium alloys, the most crack initiation resistant microstructure is a fine equiaxed alpha structure, while the most crack propagation resistant microstructure is associated with large groups or colonies of high aspect ratio alpha phase plates.

Relatively thick alpha+beta alloy castings generally have a transformed beta microstructure, i.e., an alpha plate microstructure. Mill annealed wrought alpha+-beta titanium alloys generally have a microstructure which is a relatively coarse mixture of low aspect ratio alpha separated by a small amount of intergranuluar beta. Articles prepared by consolidation of prealloyed alpha+beta titanium alloy powder generally have a microstructure which is a mixture of high and low aspect ratio coarse alpha plates separated by a continuous beta phase.

The microstructure of wrought, cast and powder metallurgy articles can be altered or refined by a variety of methods, including forging, beta-solution heat treatment, annealing, hydrogenation/dehydrogenation, and the like. With forging, it is possible to locally refine microstructure, so that an article will have differing microstructures in different portions of the article through control of the amount of forging work. With other microstructures refining methods, it is generally either not possible or not feasible to refine the microstructure of an article is selected locations.

Vogt et al, U.S. Pat. No. 4,680,063 disclose that the microstructure of a forged titanium alloy article can be altered by a process comprising beta-solution heat treatment, hydrogenation, cooling, dehydrogenation and cooling. Smickley et al, U.S. Pat. No. 4,505,764 disclose that the microstructure of cast titanium alloy articles can be refined by a method comprising hydrogenation, then dehydrogenation. Levin et al, U.S. Pat. No. 4,655,855 disclose that the microstructure of prealloyed titanium alloy powder compacts can be refined by a method comprising beta-solution heat treatment, cooling to room temperature, hydrogenating and dehydrogenating. Yolton et al, U.S. Pat. No. 4,219,357 disclose a method for producing powder compacts having a fine grain size which comprises hydriding a titanium alloy powder, hot compacting the hydrided powder in a suitable mold, dehydriding the resulting article, reheating the dehydrided article to remove voids formed during dehydriding.

While the methods briefly described above represent valuable contributions to the art, most have the drawback that the microstructure of the resulting article is uniform. Smickley et al disclose that the surface of castings can be modified by limiting the hydrogen partial pressure or controlling the hydrogenation time at a given pressure to limit hydrogen addition to the surface regions. This method has the drawback that it would be difficult, if not impossible, to modify the microstructure of selected and isolated surface regions. What is desired is a method for producing a titanium allooy article having at least two microstructures. In particular, what is desired is a method for producing a titanium alloy article having one or more regions which are resistant to crack initiation and one or more regions which are resistant to crack propagation.

It is, therefore, an object of the present invention to provide a method for producing titanium alloy articles having high fatigue and fracture resistance.

Other objects of the invention will become apparent to those skilled in the art from a reading of the following description of the invention.

SUMMARY OF THE INVENTION

In accordance with the present invention, there is provided a method for producing an integral titanium alloy article having at least two regions, each region having a distinct microstructure, which comprises the steps of (a) providing a suitable mold for the article;
(b) introducing a first titanium alloy into a first portion of the mold;
(c) introducing a second titanium alloy in powder form into a second portion of the mold; and
(d) hot compacting the first and second alloys in the mold to produce a substantially fully dense article.

In one embodiment of the invention, the second alloy is the hydrided version of the first alloy.

In another embodiment of the invention, the second alloy has a different overall composition from the first alloy.

In yet another embodiment of the invention, the second alloy is hydrided and has a different overall composition from the first alloy.

DETAILED DESCRIPTION OF THE INVENTION

Figure 1:
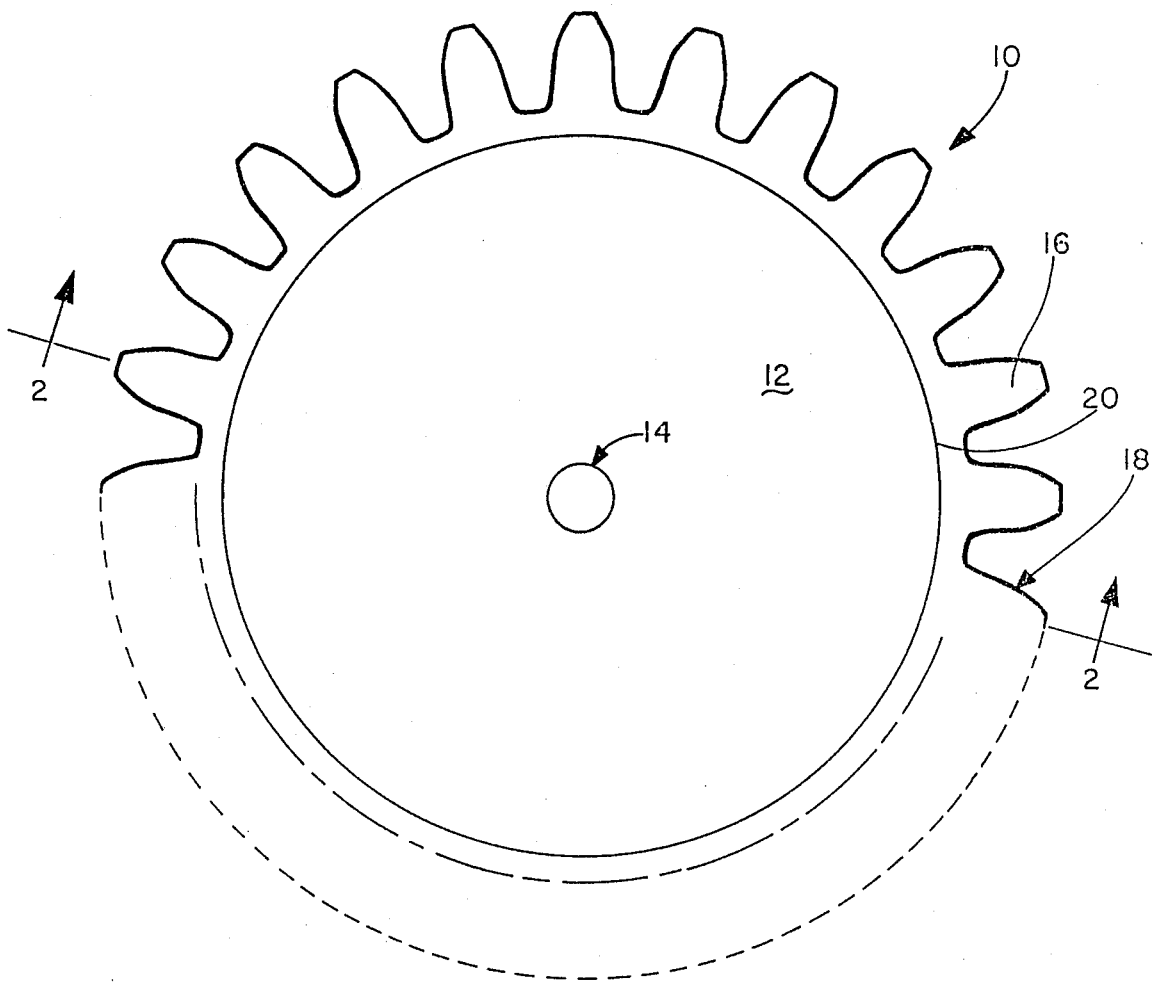
FIG. 1 is a top view of a gear wheel produced according to the invention.

As discussed previously, the present invention provides a method for producing an integral titanium alloy article having at least two regions, each region having a distinct microstructure. The method, as well as the advantages of the invention are illustrated in the drawing which illustrates a simple gear wheel. It should be understood that the method of the invention may be employed to fabricate more complex shapes, sucha turbine compressor wheels with integral blades, pump impeller wheels and the like. In articles such as gears, turbine wheels and pump impellers, fatigue cracks initiate at the outer surface and propagate into the hub section. Referring now to the drawing, FIG. 1 illustrates a gear wheel 10 consisting of a circular disk 12 with a centered hole 14, for mounting gear 10 to a shaft, and a concentric gear ring 16 having a plurality of gear teeth 18 suitably spaced around the periphery of ring 16. The demarcation line 20 between disk 12 and ring 16 is for illumination only and would not be apparent in a finished gear wheel. The gear ring 16 has a fine equiaxed alpha microstructure which is fatigue crack initiation resistant while the disk 12 has a high aspect ratio alpha plate microstructure which is fatigue crack propatation resistant.

Figure 2:
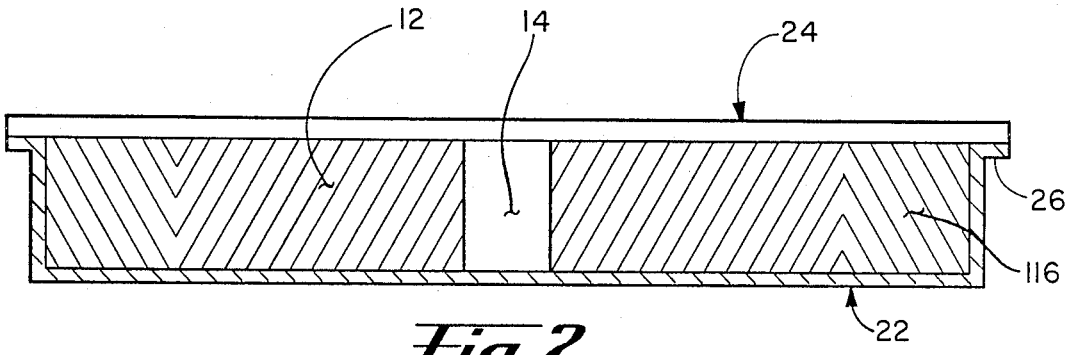
FIG. 2 is a sectional view illustrating a section through 2—2 of FIG. 1 in a mold; and, FIG. 3 illustrates another method for making the gear shown in FIG. 1.

Referring to FIG. 2, the gear 10 is fabricated in accordance with the invention by first providing a suitable mold. The mold may be a metal can, ceramic mold or a fluid die mold. The ceramic mold process relies basically on the technology developed by the investment casting industry, in that molds are prepared by the lost-wax process. In this process, wax patterns are prepared as shapes intentionally larger than the final configuration. This is necessary because in powder metallurgy a large volume difference occurs in going from the wax pattern (which subsequently becomes the mold) to the consolidated compact. Knowing the configuration aimed for in the compacted shape, allowances can be made using the packing density of the powder to define the required wax pattern shape.

In the metal can technique, a metal can is shaped to the desired configuration by state-of-the-art sheet metal methods, e.g., brake bending, press forming, spinning, superplastic forming, etc. The most satisfactory container appears to be carbon steel, which reacts minimally with the titanium, forming titanium carbide when then inhibits further reactions. Fairly complex shapes have been produced by this technique. Allowance for packing of the powder is incorporated into the metal can, just as for the ceramic mold.

In the present example, the mold is a can mold having a body 22 and a lid 24. Body 22 has a lip 26 for later sealing the lid 24 to body 22. It should be understood that the mold shown in FIG. 2 does not include allowance for packing of the alloy powder used.

A blank 12, such as a disk cut from a wrought cylinder or a cast piece, is placed, centered, in the mold body 22. The mounting hole 14 may be drilled through the disk 12 prior to fabrication of the gear, as shown, or drilled after completion. The space 116 in the mold body defining the gear ring and gear teeth is filled with a titanium alloy powder. The mold is sealed, as by evacuating the mold, then placing the lid 24 on the body 22 and crimping or welding the lid to the lip 24.

In the metal can and ceramic mold processes, the powder-filled mold is supported in a secondary pressing medium contained in a collapsible vessel, e.g., a welded metal can. Following evacuation and elevated temperature outgassing, the vessel is sealed, then placed in an autoclave or other apparatus capable of isostatically compressing the vessel. Following consolidation, the gear is recovered from the mold using techniques known in the art.

Titanium alloys which may be employed in the practice of this invention are the alpha+beta alloys. Examples of suitable alloys include Ti-6Al-4V, Ti-6Al-6V-2Sn, Ti-8Mn, Ti-7Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-2Zr-2Mo-2Cr and Ti-3Al-2.5V.

In a presently preferred embodiment of the invention, the powder is hydrogenated to a level of about 0.1 to 4.0 weight percent hydrogen, preferably about 0.5 to 1.5 weight percent hydrogen, prior to use in the present invention. Any conventional technique may be used for producing hydrogenated titanium alloy powder. For example, bulk alloy articles can be hydrogenated to provide an embrittled article which can then be crushed to powder. Alternatively, hydrogenated titanium alloy powder may be produced according to the technique set forth in Cloran et al, U.S. Pat. No. 4,009,233, which comprises the steps of hydrogenating at least a surface portion of an alloy article, locally melting the hydrogenated portion in a hydrogen-containing atmosphere and cooling the droplets produced at a rate sufficient to form discrete particles. The powder material must be protected from oxidation and contamination during storage.

Consolidation of the titanium alloy powder is accomplished by applying a pressure of at least about 10 ksi, preferably at least about 30 ksi, at a temperature of about 450 to 1100 degrees C. for about 0.25 to 24 hours. Consolidation can be carried out using hot isostatic pressing (HIP), rapid omnidirectional compaction (ROC) or other known techniques. The preferred consolidation technique is that, such as ROC, which has a relatively short heat treating and cycle time. Regardless of the consolidation technique employed, it is important that the consolidation temperature be lower than the lowest beta-transus temperature of the alloy(s) used in order to retain the desired microstructure in the consolidated article. Hydrogenated titanium alloy powder has a hydrogenated-beta-transus temperature generally about 100 to 300 degrees C. lower than the normal-beta-transus temperature of an alloy. Thus, for example, if wrought Ti-6Al-4V, which has a normal, i.e., non-hydrogenated beta-transus temperature of about 1000 degrees C., is employed for the blank 112, and Ti-6Al-4V powder hydrogenated to about 0.5 to 1.5 weight percent hydrogen, which has a hydrogenated-beta-transus temperature of about 760 to 870 degrees C, is employed to fill the space 116 in the previously described gear, consolidation would be carried out at a temperature below the hydrogenated-beta-transus temperature of the powder. In general, consolidation is carried out at a temperature about 25 to 100 degrees C. below the aforesaid lowest beta-transus temperature. Hydrogen will be retained in the compacted article since the mold 24/26 is hermetically sealed.

Following recovery of the consolidated article, it may be desirable, if a hydrogenated powder was employed to produce the article, to dehydrogenate the article. Dehydrogenation is accomplished by heating the article under vacuum to a temperature of about 200 to 350 degrees C. below the normal beta-transus temperature of the alloy. The time for hydrogen removal will depend on the size and cross-section of the article, the volume of hydrogen to be removed, the temperature of dehydrogenation and the level of vacuum in the apparatus employed. The term "vacuum" is intended to mean a vacuum of about $10^{-2}$ mm. Hg or less, preferably about $10^{-4}$ mm. Hg or less. The time for dehydrogenation must be sufficient to reduce the hydrogen content in the article to less than the maximum allowable level. For the alloy Ti-6Al-4V, the final hydrogen level must be below about 120 ppm to avoid degradation of mechanical properties. Generally, about 15 to 60 minutes of dehydrogenation temperature and under vacuum, is sufficient to ensure substantially complete evolution of hydrogen from the article.

If the volume of hydrogenated powder is low in comparison to the total volume of the article, dehydrogenation may not be required inasmuch as the hydrogen in the consolidated hydrogenated powder portion will diffuse into the non-hydrogenated portion(s) of the article. If the resulting overall hydrogen level is below the maximum allowable hydrogen level for the alloy(s), there is no need to subject the article to a dehydrogenation step.

Figure 3:
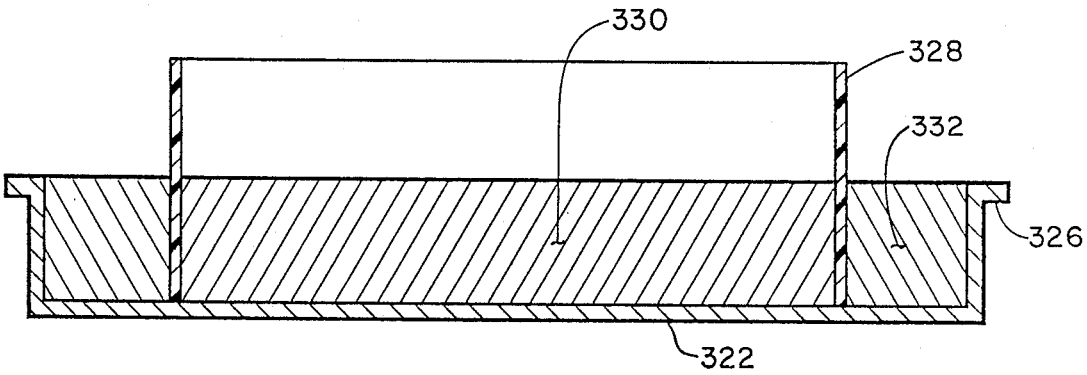

FIG. 3 illustrates an embodiment of the invention wherein an article is fabricated entirely from titanium alloy powder. Referring to FIG. 3, a can mold 322 having a lip 326 is provided with a removeable circular dam 328, which may be made of a polymer, as shown, or any suitable material. The dam 328 is centered in the mold 322. The space 330 inside the dam 328 is filled to a desired depth with a first titanium alloy powder, such as Ti-6Al-4V. The space 332 outside the dam 328, which defines the gear ring and gear teeth, is filled to a desired depth with a second titanium alloy powder, such as hydrogenated Ti-6Al-4V. The dam 328 is then carefully removed so as to leave the two powders relatively undisturbed. The mold is then sealed and the contents consolidated as described previously.

It is within the scope of this invention to fabricate an article as previously described with reference to FIG. 2 using a solid blank together with a hydrogenated powder wherein the blank and the powder are the same alloy, or as described with reference to FIG. 3, using hydrogenated and non-hydrogenated powders of the same alloy. It is also within the scope of the invention to employ two or more different titanium alloys, including their hydrogenated derivatives.

Various modifications may be made in the present invention without departing from the spirit of the invention or the scope of the appended claims.

We claim:

1. A method for producing an integral titanium alloy article having at least two regions, each region having a distinct microstructure, which comprises the steps of (a) providing a suitable mold for the article;

(b) introducing a first titanium alloy into a first portion of the mold;

(c) introducing a second titanium alloy in powder form into a second portion of the mold; and (d) hot compacting the first and second alloys in the mold to produce a substantially fully dense article.

2. The method of claim 1 wherein said second alloy is the hydrided version of said first alloy, said second alloy being hydrogenated to a level of about 0.1 to 4.0 weight percent hydrogen prior to introducing said second alloy into said mold.

3. The method of claim 2 further comprising the step of dehydrogenating the resulting compacted article.

4. The method of claim 2 wherein said second alloy is hydrogenated to a level of about 0.5 to 1.5 weight percent hydrogen.

5. The method of claim 4 further comprising the step of dehydrogenating the resulting compacted article.

6. The method of claim 4 wherein said first alloy is Ti-6Al-4V and wherein said second alloy is hydrogenated Ti-6Al-4V.

7. The method of claim 6 further comprising the step of dehydrogenating the resulting compacted article.

8. The method of claim 1 wherein said second alloy has a different overall composition from said first alloy.

9. The method of claim 8 wherein said second alloy is hydrogenated to a level of about 0.1 to 4.0 weight percent hydrogen prior to introducing said second alloy into said mold.

10. The method of claim 8 wherein said second alloy is hydrogenated to a level of about 0.5 to 1.5 weight percent hydrogen.

11. The method of claim 9 further comprising the step of dehydrogenating the resulting compacted article.

12. The method of claim 10 further comprising the step of dehydrogenatig the resulting compacted article.

13. The method of claim 1 wherein said first and second alloys are compacted at a temperature lower than the lowest beta transus temperature of said first and second alloys.

* * * * *

UNITED STATES PATENT AND TRADEMARK OFFICE

CERTIFICATE OF CORRECTION

PATENT NO. : 4,828,793

DATED : May 9, 1989

INVENTOR(S) : Francis H. Froes et al

It is certified that error appears in the above-identified patent and that said Letters Patent is hereby corrected as shown below:

Col 1, line 49, "microstructures" should read "microstructure".

Col 1, line 51, "is" should read "in".

Col 2, line 13, "allooy" should read "alloy".

Col 2, line 67, "sucha" should read "such a".

Col 3, line 10, "illumination" should read "illustration".

Col 3, line 55, "24" should read "26".

Col 5, line 2, "of" should read "at".

Signed and Sealed this

Tenth Day of July, 1990

*Attest:*

HARRY F. MANBECK, JR.

*Attesting Officer*

*Commissioner of Patents and Trademarks*